US005124003A

United States Patent [19]

Martens et al.

[11] Patent Number: 5,124,003

[45] Date of Patent: Jun. 23, 1992

[54] APPARATUS FOR THE STEAM CRACKING OF HYDROCARBONS FOR THE PREPARATION OF OLEFINS AN DIOLEFINS

[75] Inventors: André Martens; Serge Bellet, both of Chateauneuf Les Martigues; Jean-Pierre Toulet, Saint Germain En Laye, all of France

[73] Assignee: Naphtachimie S. A., Courbevoie, France

[21] Appl. No.: 607,606

[22] Filed: Oct. 30, 1990

Related U.S. Application Data

[60] Continuation of Ser. No. 403,799, Sep. 5, 1989, abandoned, which is a continuation of Ser. No. 172,510, Mar. 24. 1988, abandoned, which is a division of Ser. No. 063,142, Jun. 16, 1987, Pat. No. 4,777,318.

[30] Foreign Application Priority Data

Jun. 25, 1986 [FR] France ..... 8609217
Jun. 25, 1986 [FR] France ..... 8609218
Jun. 25, 1986 [FR] France ..... 8609220

[51] Int. Cl.[5] ..... C10G 9/20

[52] U.S. Cl. ..... 196/110; 196/116; 422/197; 422/204

[58] Field of Search ..... 196/110, 116; 422/196, 422/197, 204, 312; 48/94

[56] References Cited

U.S. PATENT DOCUMENTS 2,917,564 12/1959 Pollock ..... 208/132
2,994,724 8/1961 Hillard et al. ..... 208/132
3,112,880 12/1963 Pollock ..... 208/132
3,306,844 2/1967 Brierley et al. ..... 208/132
3,348,923 10/1967 Demarest ..... 196/110
3,503,949 3/1970 Gaspari ..... 422/197
3,630,850 12/1971 Dorresteyn ..... 196/110
3,671,198 6/1972 Wallace ..... 196/116
4,342,642 8/1982 Bauer et al. ..... 422/197

FOREIGN PATENT DOCUMENTS 1165907 10/1969 United Kingdom .
1177181 1/1970 United Kingdom .

*Primary Examiner*—Joye L. Woodard
*Attorney, Agent, or Firm*—Brooks Haidt Haffner and Delahunty

[57] ABSTRACT

Apparatus for the cracking of hydrocarbons in the presence of steam for the production of olefins and diolefins which includes a thermal radiation enclosure enclosing at least one cracking tube having an inlet to which the hydrocarbons and steam are supplied and having an outlet for the cracking products. The internal diameter of the tube diminishes continuously or discontinuously from the inlet to the outlet and the ratio between the internal diameters of the tube at the inlet and the outlet is between 1.2 and 3. The ratio of the length of the tube within the enclosure to the mean internal diameter of the tube is between 200 and 600. Heat is supplied to the tube by burners within the enclosure so that the thermal power applied along the length of the tube increases in the direction from the inlet to the outlet and so that the ratio between the thermal power applied to the half of the tube extending from the inlet to the thermal power applied to the remaining half of the tube is between 40/60 and 15/85.

14 Claims, 5 Drawing Sheets

APPARATUS FOR THE STEAM CRACKING OF HYDROCARBONS FOR THE PREPARATION OF OLEFINS AN DIOLEFINS

This application is a continuation of application Ser. No. 07/403,799, filed Sep. 5, 1989, abandoned which is a continuation of Ser. No. 07/172,510 filed Mar. 24, 1988, abandoned, which is a division of Ser. No. 07/063,142 filed Jun. 16, 1987, now U.S. Pat. No. 4,777,318.

The invention relates to a process for cracking hydrocarbons in the presence of steam with the purpose of preparing of olefins and diolefins, more particularly ethylene. The invention also relates to an apparatus formed by a cracking furnace intended for the performance of the process.

It is known to crack with steam liquid hydrocarbons having 5 to 15 carbon atoms, such as naphtha, light gasolines and gas oil, or gaseous hydrocarbons, more particularly gaseous alkanes having 2 to 4 carbon atoms, possibly mixed with methane and/or alkenes having 2 to 4 carbon atoms, in furnaces whose outlet temperature is generally between 750° C. and 880° C. In this process, known as steam cracking or pyrolysis, a mixture of hydrocarbons and steam flowing in a cracking tube disposed in the form of a coil inside a furnace is passed through the radiant portion thereof, the pressure of the mixture at the outlet of the furnace being generally between 120 kPa and 240 kPa. The hydrocarbons are therefore converted partly into olefins generally having 2 to 6 carbon atoms, more particularly ethylene, into propylene and isobutene, and possibly into diolefins, such as butadiene and partly into undesirable byproducts, such as methane and gasolines. It is known more particularly that ethylene is formed at a higher temperature than the higher olefins having at least 3 carbon atoms. It is also known that these higher olefins experience at elevated temperatures in the presence of hydrogen secondary hydrocracking and condensation reactions which encourage the formation of light hydrocarbons and gasoline. As a rule, in such a steam cracking processes the yield of olefins and diolefins is determined by the ratio by weight between the quantities of olefins produced having 2 to 4 carbon atoms and of butadiene produced and the quantity of hydrocarbons used.

The prior art steam cracking processes more particularly using liquid hydrocarbons are clearly performed with the object of obtaining the highest possible yield of olefins and diolefins, but in conditions which encourage the production of ethylene in comparison with those of the other olefins and diolefins. To obtain this result the steam cracking furnaces are as a rule designed to operate in heavy duty conditions. These conditions are such that the mixture of hydrocarbons and steam flowing in the cracking tube disposed in the form of a coil inside the radiant zone of a furnace is subject to a high temperature and a low pressure for a relatively short time.

It is also known that the development of industrial installations for the steam cracking of gaseous hydrocarbons, such as natural gas, mainly formed by ethane, has resulted in ethylene surpluses on the market. Several years ago, therefore, it became urgently necessary to modify the steam cracking processes of liquid hydrocarbons, with the objective of substantially enhancing the production of the higher olefins and diolefins in comparison with the production of ethylene. However, having regard to the considerable size of industrial steam cracking installations and the heavy cost of investments, the envisaged modification of the process might possibly involve excessive and expensive conversions of the existing steam cracking units. Neither is it economically justifiable for the process of steam cracking hydrocarbons to be modified by accepting a drop, however slight it might be, in the yield of olefins and diolefins. Numerous studies have therefore been carried on for several years in this field and unceasing research efforts carried out at both the laboratory and industrial stages.

In the prior art steam cracking processes, which generally use fairly cheap gaseous hydrocarbons, such as natural gas, the objective is to convert the largest possible quantity of gaseous hydrocarbons into olefins. The processes are therefore performed with the objective of obtaining a high conversion rate, the conversion rate being defined by the ratio by weight between the quantity of hydrocarbons converted and the quantity of hydrocarbons used. However, the high conversion rate is generally obtained at the cost of the selectivity of the steam cracking reaction as regards olefins, more particularly ethylene, the ethylene selectivity being defined by the ratio by weight between the quantity of ethylene produced and the quantity of gaseous hydrocarbons converted.

These processes are performed using steam cracking furnaces which are also designed to operate in heavy duty conditions. However, the processes using such steam cracking furnaces may have serious disadvantages, such as considerable coking inside the cracking tube and premature aging of the steam cracking installations.

In dependence on economic circumstances, the steam cracking processes can use gaseous hydrocarbons of a relatively higher cost, such as liquefied petroleum gas (LPG), or ethane, a byproduct of the steam cracking of liquid hydrocarbons, such as naphtha or gas oil. In that case it is advantageous to look for a steam cracking process having the highest possible ethylene selectivity, more particularly a process enabling the lowest possible quantity of undesirable byproducts, such as methane, to be produced for a given quantity of ethylene. Some years ago it also became a matter of urgency to modify the steam cracking processes of gaseous hydrocarbons with the objective of substantially enhancing the ethylene selectivity of the steam cracking reactions.

A process has now been discovered and also a furnace for the cracking of liquid or gaseous hydrocarbons in the presence of steam, which, in the case of liquid hydrocarbons, not only enables propylene, isobutene and butadiene production to be very substantially enhanced in comparison with ethylene production, but also allows a significant enhancement of the cracking yield of olefins and diolefins, and in the case of gaseous hydrocarbons, a very substantial enhancement of the ethylene selectivity of the steam cracking reaction, while at the same time very appreciably reducing the quantity of methane produced and obviating the aforementioned disadvantages. The process and apparatus according to the invention can moreover be readily adapted to existing steam cracking installations.

The invention relates firstly to a process for the preparation of olefins and diolefins by the cracking of hydrocarbons in the presence of steam, consisting in passing a mixture of hydrocarbons and steam flowing in a cracking tube disposed inside a radiation zone of a furnace through such zone at a furnace outlet pressure of between 120 and 240 kPa, the cracking temperature of the mixture being between 400° C. and 700° C. at the inlet of the radiation zone and between 720° and 880° C. at the outlet of such zone, the process being characterized in that (a) the mean dwell time of the mixture of hydrocarbons and steam flowing in the cracking tube between the inlet and the outlet of the radiation zone is between 300 and 1800 milliseconds, and (b) the reaction volume of the first half of the length of the cracking tube, situated towards the inlet of the radiation zone, is 1.3 to 4 times greater than that of the second half of the tube length, situated towards the outlet of such zone.

The invention also relates to an apparatus for cracking hydrocarbons in the presence of steam, comprising a thermal radiation enclosure having a plurality of heating means, at least one cracking tube within the enclosure through which the mixture of steam and hydrocarbons for cracking flows, the cracking tube having a length, an inlet, an outlet, a lengthwise first half situated towards the inlet, a lengthwise second half situated towards the outlet, and a varying internal diameter with a mean internal diameter, wherein:

(a) the ratio between the length and the mean internal diameter of the cracking tube within the thermal radiation enclosure is between 200 and 600, and (b) the internal diameter of the cracking tube varies such that said internal diameter diminishes continuously or discontinuously in the direction from the inlet to the outlet, so that the ratio between the internal diameters of the tube at the inlet and outlet is between 1.2 and 3, and, (c) each of the plurality of heating means is of different thermal power and is disposed within the enclosure with the heating means of lower thermal power disposed nearer the inlet than the heating means of higher thermal power for providing a ratio between the thermal power applied to the lengthwise first half of the cracking tube and that applied to the lengthwise second half of the cracking tube between 40/60 and 15/85.

The plurality of heating means comprises a plurality of burners of different sizes disposed in spaced relation in the direction from the inlet to the outlet with the burners of smaller size disposed nearer the inlet than the burners of larger size.

Figure 1:
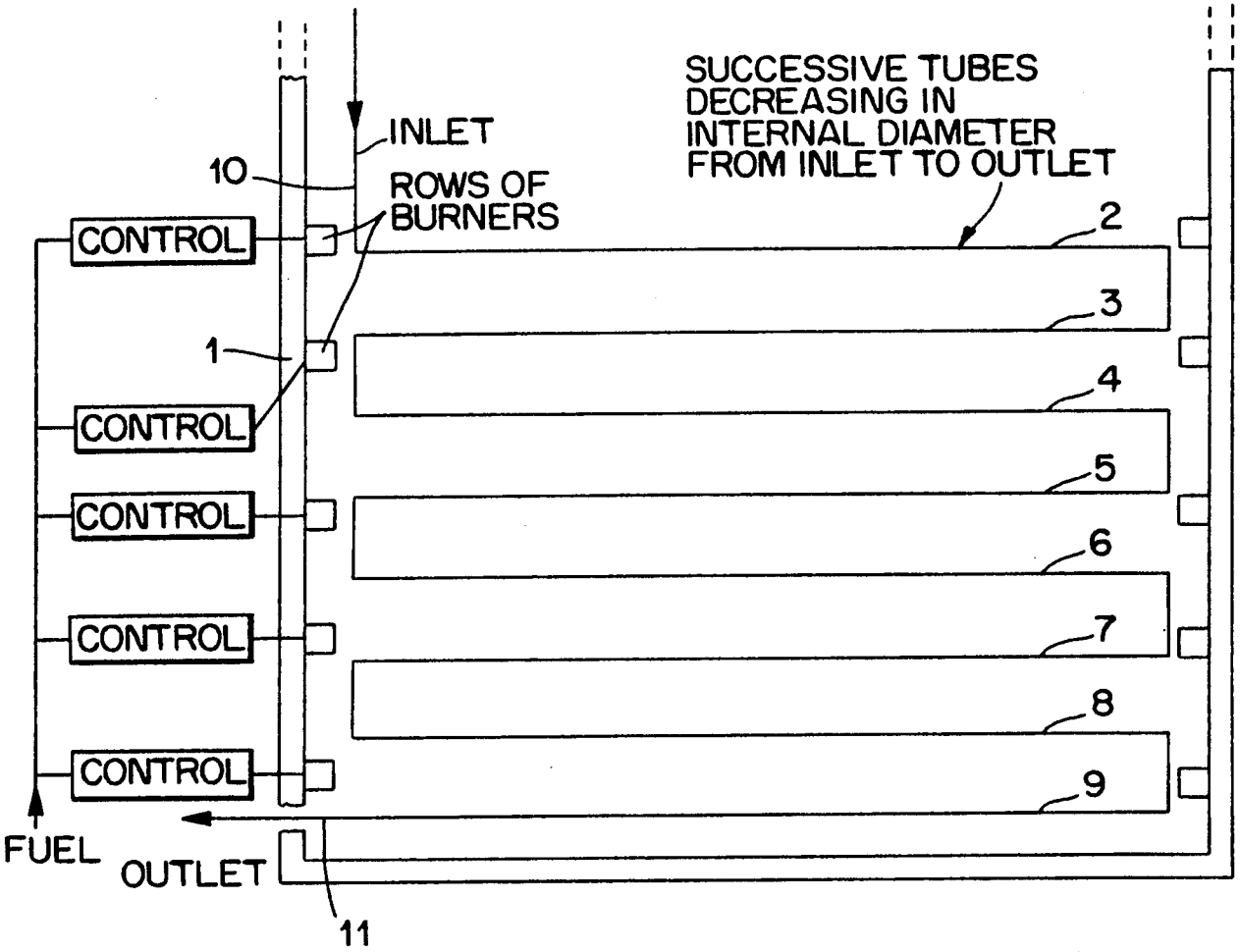
FIG. 1 shows diagrammatically a horizontal steam cracking furnace comprising a thermal radiation enclosure (radiation zone) through which a cracking tube disposed in the form of a coil extends.

The cracking temperature of the mixture of hydrocarbons and steam increases along the cracking tube, between the inlet and outlet of the furnace radiation zone—i.e., in the direction in which the mixture flows. Preferably the mixture of hydrocarbons and steam is preheated before it enters the radiation zone of the furnace, such preheating being performed by any known means, more particularly in a heating zone by the convection of the furnace. More particularly, in the case of liquid hydrocarbons, the cracking temperature of the mixture of hydrocarbons and steam is at the inlet of the radiation zone of the furnace between 400° C. and 650° C., preferably between 430° C. and 580° C.; at the outlet of the zone it is between 720° C. and 860° C., preferably between 760° C. and 810° C. In the case of gaseous hydrocarbons, the cracking temperature of the mixture of hydrocarbons and steam is between 500° C. and 700° C. at the inlet of the radiation zone of the furnace, preferably between 550° C. and 660° C.; at the outlet of the zone it is between 800° C. and 880° C., preferably between 810° C. and 850° C.

The process according to the invention is characterized by a mean dwell time of the mixture of hydrocarbons and steam flowing in the cracking tube between the inlet and outlet of the radiation zone of the furnace. The mean dwell time may be relatively longer than that normally used in the processes for steam cracking hydrocarbons in heavy duty conditions. It is generally between 300 and 1800 milliseconds, preferably between 400 and 1400 milliseconds, more particularly when the hydrocarbons used are gaseous. It is moreover between 850 and 1800 milliseconds, preferably between 870 and 1500 milliseconds, and more particularly between 900 and 1400 milliseconds than when hydrocarbons used are liquid.

The process according to the invention is also characterized by the reaction volume of the cracking tube which in the first half of the tube length, situated towards the inlet of the radiation zone, is 1.3 to 4 times greater, preferably 1.5 to 2.5 times greater than that of the second half of the tube length, situated towards the outlet of such zone. More particularly, the reaction volume per unit of cracking tube length diminishes continuously or discontinuously from the inlet to the outlet of the radiation zone of the furnace. In practice the reduction is preferably performed discontinuously, in stages along the cracking tube.

It has been found that in these conditions the mean dwell time of the mixture per unit of length of the cracking tube, also called the partial dwell time, is not constant along the cracking tube from the inlet to the outlet of the radiation zone of the furnace, but tends to decrease significantly in the direction in which the mixture flows in the cracking tube. More precisely, the mean dwell time of the mixture flowing in the first half of the tube length, situated towards the inlet of the radiation zone of the furnace, is 2 to 4 times greater, preferably 2.6 to 3 time greater than that existing in the second half of the tube length, situated towards the outlet of such zone. It is also observed that the apparent surface velocity of the mixture of hydrocarbons and steam flowing in the cracking tube increases in the direction in which the mixture flows. Thus, the velocity is relatively low in the first half of the length of the cracking tube, situated towards the inlet of the radiation zone, for example between 30 and 80 m/sec, and higher in the second half of the tube length, situated towards the outlet of the radiation zone, for example, between 90 and 150 m/sec. The process according to the invention therefore enables the mixture of hydrocarbons and steam to pass relatively slowly through the portion of the cracking tube where the temperature is relatively low, but more quickly through the portion of the cracking tube where the temperature is highest. It therefore allows not only an enhancement in the production of polypropylene, isobutene and butadiene in comparison with that of ethylene, but also an enhancement in the cracking yield of olefins and diolefins, more particularly when liquid hydrocarbons are used.

However, it has been noted that the best results are obtained when the increase in the cracking temperature of the mixture of hydrocarbons and steam between the inlet and outlet of the radiation zone of the furnace is associated with a non-homogeneous distribution of the thermal power of the furnace applied along the tube, the distribution being such that the thermal power applied to the second half of the tube length, situated towards the outlet of the radiation zone, is 1.5 to 5 times greater than that applied to the first half of the tube length, situated towards the inlet of such zone.

The cracking temperature of the mixture of hydrocarbons and steam thus does not increase uniformly along the tube, between the inlet and the outlet of the radiation zone of the furnace. More precisely, the increase in the cracking temperature of the mixture is relatively moderate in the first half of the tube length, situated towards the inlet of the radiation zone of the furnace, while the increase in the cracking temperature of the mixture is more considerable in the second half of the tube length, situated towards the outlet of the radiation zone of the furnace. The cracking temperature of the mixture of hydrocarbons and steam flowing between the inlet and the outlet of the radiation zone of the furnace is controlled by a graduated distribution of the thermal power applied to the tube. More particularly, the thermal power applied to the second half of the tube length, situated towards the outlet of the radiation zone of the furnace, is 1.5 to 5 times greater, preferably 2 to 4 times greater than that applied to the first half of the tube length, situated towards the inlet of such zone. The term thermal power here means the quantity of heat contributed per unit of time and unit of volume of the furnace enclosing the cracking tube.

It is observed that in these conditions the combination of a non-homogeneous distribution of the thermal power applied along the cracking tube with a reaction volume decreasing per unit of cracking tube length results in a significant increase in the mean dwell time of the mixture in the first half of the cracking tube length, situated towards the inlet of the radiation zone of the furnace. The effect of this combination therefore enables the mixture of hydrocarbons and steam to pass relatively slowly through the portion of the cracking tube where the thermal power applied is lowest, while passing more quickly through the portion of the tube where the thermal power applied is highest. The result of this is to simultaneously considerably enhance the production of propylene, isobutene and butadiene in comparison with the production of ethylene, and the cracking yield of olefins and diolefins, more particularly when liquid hydrocarbons are used in the process. Another result of this combination is to enhance the ethylene selectivity of the steam cracking reaction and to significantly reduce the quantity of methane produced, more particularly when the hydrocarbons used are gaseous. The result is moreover obtained with an improved thermal radiation yield in comparison with the prior art processes, due to a relatively lower mean cracking temperature.

The process according to the invention provides other advantages, more particularly allowing a reduction in the coking taking place inside the cracking tube. It also enables the service life of a steam cracking installation to be lengthened, since it thus operates at a relatively low mean cracking temperature.

The composition of the mixture of hydrocarbons and steam used in the process according to the invention is such that the ratio by weight between the quantity of hydrocarbons and the quantity of steam is between 1 and 10, preferably between 2 and 6, more particularly when gaseous hydrocarbons are used, and preferably between 3 and 6, more particularly when liquid hydrocarbons are used.

The liquid hydrocarbons used in mixture with steam can be selected from naphtha, formed by hydrocarbons having about 5 to 10 carbon atoms, light gasolines formed by hydrocarbons having about 5 or 6 carbon atoms, gas oil formed by hydrocarbons having about 8 to 15 carbon atoms, and their mixtures. They can also be used mixed with saturated and unsaturated hydrocarbons having 3 to 6 carbon atoms.

The gaseous hydrocarbons used in the mixture with steam are formed by alkanes having 2 to 4 carbon atoms, more particularly ethane, propane or butane, or mixtures thereof. The alkanes can be used possibly mixed with alkenes having 2 to 6 carbon atoms and/or methane and/or alkanes having 5 to 6 carbon atoms. More particularly use can be made in the process according to the invention of natural gas or liquefied petroleum gas (LPG) or ethane, a byproduct of the steam cracking of liquid hydrocarbons, such as naphtha or gas oil.

The process according to the invention, using liquid hydrocarbons, is particularly advantageous for enhancing the production of the higher olefins and diolefins in comparison with that of ethylene, more particularly the production of olefins having 3 or 4 carbon atoms, such as propylene and isobutene and the production of diolefins, such as butadiene. This advantage can more particularly be appreciated by defining on the one hand a selectiveity, $S_3$, in produced hydrocarbons having 3 carbon atoms, and on the other hand a selectivity, $S_4$, in produced hydrocarbons having 4 carbon atoms, in accordance with the following equations:

$$S_3 = \frac{\text{total weight of produced hydrocarbons having 3 carbon atoms}}{\text{total weight of produced hydrocarbons having 2 carbon atoms}}$$

and $$S_4 = \frac{\text{total weight of produced hydrocarbons having 4 carbon atoms}}{\text{total weight of produced hydrocarbons having 2 carbon atoms}}$$

Thus the process enables the steam cracking of liquid hydrocarbons to be performed with a selectivity $S_3$ equal to or greater than 0.73 and a selectivity $S_4$ equal to or greater than 0.51, when the thermal power is applied homogeneously along the cracking tube. The selectivities $S_3$ and $S_4$ can become equal to or greater than 0.78 and 0.57 respectively then the thermal power is applied non-homogeneously along the cracking tube, by the process according to the invention.

The invention also relates to an apparatus enabling the aforedisclosed process for the steam cracking of hydrocarbons to be performed, more particularly an apparatus formed by a furnace for cracking hydrocarbons in the presence of steam, comprising a thermal radiation enclosure having heating means, at least one cracking tube in which the mixture of steam and hydrocarbons for cracking flows extending through the enclosure, the apparatus being characterized in that (a) the ratio between the length and the mean internal diameter of the cracking tube extending through the thermal radiation enclosure is between 200 and 600, and (b) the internal diameter of the cracking tube diminishes continuously or discontinuously from the inlet to the outlet of the thermal radiation enclosure, so that the ratio between the internal diameters of the tube at the inlet and outlet of such enclosure is between 1.2 and 3.

The steam cracking furnace according to the invention comprises a thermal radiation enclosure through which at least one cracking tube disposed in the form of a horizontal or vertical coil extends. The cracking tube must have a length/mean internal diameter ratio of between 200 and 600, preferably between 300 and 500. More particularly, when liquid hydrocarbons are used in the furnace, the mean internal diameter of the cracking tube is preferably equal to or greater than 100 mm, so that the mean dwell time of the mixture in the cracking tube can be relatively considerable and the load losses of the mixture flowing in the cracking tube can be low. However, the mean internal diameter and length of the tube must remain within ranges of values compatible with the mechanical and thermal stresses to which the materials of which the cracking tube is made are subjected. More particularly, the mean internal diameter of the cracking tube may not exceed about 250 mm. Moreover, when gaseous hydrocarbons are used in the furnace, the mean internal diameter of the cracking tube can be between 70 mm and 160 mm, preferably between 80 and 150 mm.

The internal diameter of the cracking tube also diminishes continuously or discontinuously from the inlet to the outlet of the thermal radiation enclosure of the furnace—i.e., in the direction in which the mixture of hydrocarbons and steam flows. More particularly, the reduction in the internal diameter of the cracking tube is such that the ratio between the internal diameters of the tube at the inlet and outlet of the thermal radiation enclosure is between 1.2 and 3, preferably between 1.4 and 2.2, more particularly between 1.4 and 2. In practice, when liquid hydrocarbons are used in the furnace, the internal diameter of the cracking tube at the inlet of the thermal radiation enclosure is preferably between 140 and 220 mm, and that at the outlet of the enclosure is preferably between 70 and 120 mm. Moreover, when gaseous hydrocarbons are used in the furnace, the internal diameter of the cracking tube at the inlet of the thermal radiation enclosure is preferably between 110 and 180 mm, and that at the outlet of the enclosure is preferably between 60 and 100 mm. These values take into account the fact that the intention is to avoid an excessive increase in the load losses of the cracking tube, more particularly in the portion where the internal diameter of the tube is smallest. The internal diameter can diminish continuously all along the cracking tube. However, it is preferred to use a cracking tube formed by a succession of tubes having an internal diameter which decreases from the inlet to the outlet of the thermal radiation enclosure of the furnace.

In practice the cracking tube is disposed in the form of a coil formed by a succession of straight portions interconnected via bends, the straight portions having internal diameters which decrease from the inlet to the outlet of the thermal radiation enclosure.

FIG. 1 illustrates diagrammatically a horizontal steam cracking furnace comprising a thermal radiation enclosure (1) through which a cracking tube extends which is disposed in the form of a coil formed by eight straight horizontal portions interconnected via bends, the sections (2) and (3) having an internal diameter of 172 mm, the sections (4) and (5) an internal diameter of 150 mm, the sections (6) and (7) an internal diameter of 129 mm and the sections (8) and (9) an internal diameter of 108 mm, the inlet and outlet of the cracking tube in the thermal radiation enclosure having the references (10) and (11) respectively.

In one variant a cracking tube can be used which as soon as it enters the thermal radiation enclosure of the furnace is divided into a cluster of parallel tubes whose internal diameter can be constant and whose number diminishes from the inlet to the outlet of the thermal enclosure, so that the reaction volume formed by the assembly of tubes corresponding to the first half of the length of the cracking tube is 1.3 to 4 times greater, preferably 1.5 to 2.5 times greater than that corresponding to the second half of the tube length.

The steam cracking furnace according to the invention comprises a thermal radiation enclosure having heating means formed by burners disposed, for example, in rows on the grid and/or the walls of the enclosure. The arrangement, control and/or size of the burners in the thermal enclosure are such that the thermal power can be distributed homogeneously along the tube, and the mixture of hydrocarbons and steam is subjected to a temperature which increases rapidly in the first half of the tube, then more slowly in the second half of the tube. At any rate, the maximum heating power must be such that the skin temperature does not exceed the limit compatible with the nature of the metal or alloy from which the cracking tube is made.

It has, however, been observed that the best results are obtained when the steam cracking furnace comprises a heating means formed by burners whose thermal power increases along the cracking tube, from the inlet to the outlet of the thermal radiation enclosure, so that the ratio between the thermal power of the burners applied to the first half of the length of the cracking tube, situated towards the inlet of the thermal radiation enclosure, and that applied to the second half of the tube length, situated towards the outlet of such enclosure, is between 40/60 and 15/85, preferably between 33/67 and 20/80. The burners can be so arranged, controlled and/or dimensioned in the thermal enclosure that the thermal power increases along the cracking tube from the inlet to the outlet of the enclosure. This increasing profile of the thermal power of the burners applied along the cracking tube can readily be obtained by suitably controlling the flow rate of the gas or fuel gas supplied to each of the burners. Another way is to dispose burners of appropriate size and thermal power in the thermal enclosure. At any rate, the maximum heating power must be such that the skin temperature does not exceed the limit compatible with the nature of the metal or alloy from which the cracking tube is made.

The following non-limitative Examples illustrate the invention.

EXAMPLE 1

A steam cracking furnace, such as that shown diagrammatically in FIG. 1, comprised a brickwork thermal radiation enclosure (1) formed by a rectangular parallelipiped whose internal dimensions were length: 9.75 m; width: 1.70 m and height: 4.85 m. Disposed in the enclosure (1) was a nickel and chromium based refractory steel cracking tube having a mean internal diameter of 140 mm, a thickness of 8 mm and, having regard to the capacity of the enclosure (1), a total length of 64 m between the inlet (10) and the outlet (11). The ratio between the length and the mean internal diameter of the tube was 457. The cracking tube was disposed in the form of a coil comprising 8 horizontal straight portions each of equal length which were interconnected via bends. The internal diameter of the sections (2) and (3) situated towards the inlet of the thermal enclosure was 172 mm; the following sections (4) and (5) had an internal diameter of 150 mm; then the sections (6) and (7) had an internal diameter of 129 mm; the internal diameter of the sections (8) and (9) situated towards the outlet of the thermal enclosure was 108 mm.

Moreover, the internal diameters of the cracking tube at the inlet (10) and outlet (11) of the enclosure (1) being 172 mm and 108 mm respectively, the ratio between the internal diameters of the tube at the inlet and outlet was therefore 1.6. The reaction volume of the first half of the cracking tube length, corresponding to the straight portions (2), (3), (4), (5), was moreover 1.84 times greater than the reaction volume of the second half of the cracking tube length, corresponding to the straight portions (6), (7), (8) and (9).

The thermal radiation enclosure of the steam cracking furnace had burners disposed on the walls of the enclosure in five horizontal rows equally spaced out from one another. The thermal power of the assembly of burners was homogeneously distributed between these five rows.

A mixture of liquid hydrocarbons and steam flowed in the cracking tube. The liquid hydrocarbons were formed by a naphtha of density 0.718 having an ASTM distillation range of 45°/180° C. and contents by weight of 35% linear paraffin waxes, 29.4% branched paraffin waxes, 28.3% cyclane compounds and 7.3% aromatic compounds. The composition of the mixture of naphtha and steam used was such that the ratio by weight between the quantity of naphtha and the quantity of steam was 4. The naphtha was therefore introduced into the cracking tube at a flow rate of 3500 kg/h and the steam at a flow rate of 875 kg/h.

Figure 4:
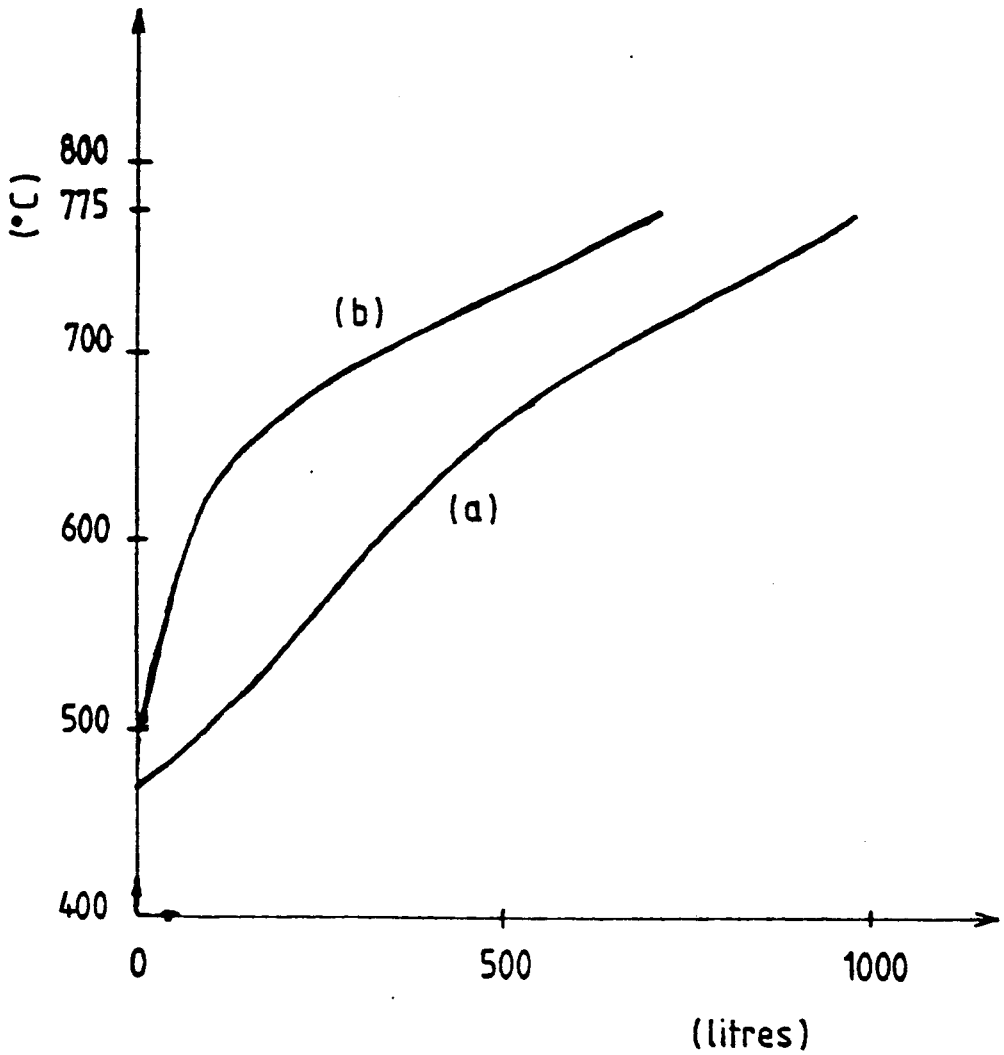
FIG. 4 is a graph showing the increase in the cracking temperature of a mixture of hydrocarbons and steam flowing in a cracking tube from the inlet to the outlet of the radiation zone of a horizontal steam cracking furnace, as a function of the mean dwell time reaction volume through which the mixture passes.

The cracking temperature of the mixture of naphtha and steam rose from 470° C. at the inlet of the radiation zone of the furnace up to 775° C. at its outlet. The development of the cracking temperature of the mixture along the cracking tube is described by curve (a) in FIG. 4, showing on the abscissa axis the reaction volume (in liters) through which the mixture flows, and on the ordinate axis the cracking temperature (in °C.) of the mixture. The curve (a) shows that the cracking temperature of the mixture increases in its initial portion relatively slowly as a function of the reaction volume through which it passes. The pressure of the mixture at the furnace outlet was 170 kPa.

The mean dwell time of the mixture of naphtha and steam flowing in the cracking tube between the inlet and the outlet of the furnace radiation zone was 1030 milliseconds. The mean dwell time of the mixture flowing in the first half of the cracking tube length was moreover 2.3 times greater than that in the second half of the tube length.

In these conditions 580 kg ethylene, 520 kg propylene, 105 kg isobutene, 165 kg butadiene and 145 kg ethane were produced per hour. The ethane thus produced in the furnace was then subjected to a secondary steam cracking stage enabling it to be converted into ethylene with a yield by weight of 85%, thus improving the global ethylene production of the steam cracking installation. It was also noted that the productions of higher olefins and butadiene were relatively high in relation to ethylene production. Thus, for 1 tonne of ethylene produced and collected at the outlet of the steam cracking installation, the productions of propylene, isobutene and butadiene were 740 kg, 150 kg and 235 kg respectively.

Moreover, the selectivity $S_3$ in produced hydrocarbons having 3 carbon atoms and the selectivity $S_4$ in produced hydrocarbons having 4 carbon atoms were as follows:

$$S_3 = 0.74$$

$$S_4 = 0.53$$

These two relatively high values indicate that the reaction of naphtha steam cracking thus performed encourages the formation of olefins having 3 to 4 carbon atoms and also the formation of butadiene.

EXAMPLE 2

Operations were performed in a steam cracking furnace identical with that of Example 1. A mixture of naphtha and steam identical with that used in Example 1 flowed in the cracking tube. The flow rates of the naphtha and the steam flowing in the tube were 4800 kg/h and 1200 kg/h respectively; this increase of the flow rates in comparison with that of example 1 could easily be achieved, since the cracking tube used had a relatively low load loss.

In these conditions the cracking temperature of the mixture of naphtha and steam rose from 480° C. at the inlet of the radiation zone of the furnace up to 775° C. at the outlet of such zone. The pressure of the mixture was 170 kPa at the outlet of the furnace.

In these conditions the mean dwell time of the mixture of naphtha and steam flowing in the cracking tube between the inlet and the outlet of the radiation zone of the furnace was 900 milliseconds. Moreover, the mean dwell time of the mixture flowing in the first half of the cracking tube length was 2.3 times greater than that in the second half of the tube length. The resulting hourly production was 640 kg ethylene, 612 kg propylene, 122 isobutene, 200 butadiene and 170 ethane. The ethane thus produced in the furnace was then subjected to a secondary steam cracking stage enabling it to be converted into ethylene with a yield by weight of 85%, thus enhancing the global ethylene production of the steam cracking installation. It was found that the productions of olefins and diolefins were higher than those of Example 1, because of the increased flow rates of raw materials which the steam cracking furnace according to the invention enables to be achieved. It was also observed that the productions of higher olefins and butadiene were relatively high in relation to ethylene production. Thus, the productions of propylene, isobutene and butadiene were respectively 780 kg, 155 kg and 255 kg for 1 tonne of ethylene produced and collected at the outlet of the steam cracking installation.

The $S_3$ and $S_4$ selectivities were also as follows:

$S_3=0.77$ $S_4=0.56.$

These two relatively high values indicated that for this kind of furnace using the process according to the invention, the naphtha steam cracking reaction encourages the formation of olefins having 3 to 4 carbon atoms, and also the formation of butadiene, at the expense of the formation of ethylene.

EXAMPLE 3 (FOR COMPARISON)

A steam cracking furnace comprised a thermal radiation enclosure identical in shape and size with that of Example 1. A nickel and chromium based refractory steel cracking tube was disposed in the enclosure and has a total weight substantially identical with that of Example 1 and an internal diameter of 108 mm, a thickness of 8 mm and, having regard to the capacity of the enclosure and the mechanical and thermal stresses of the furnace, a total length of 80 meters between the inlet and outlet of the enclosure. The ratio between the length and the mean internal diameter of the tube was 740. The cracking tube was disposed in the form of a coil comprising eight horizontal straight portions each of equal length which were interconnected via bends. The internal diameter of the straight portions was constant and equal to 108 mm. Thus, the internal diameters of the tube at the inlet and outlet of the enclosure were identical. Similarly, the reaction volume of the first half of the cracking tube length, corresponding to the first four straight portions, was identical with the reaction volume of the second half of the cracking tube, corresponding to the last four straight portions.

The thermal radiation enclosure of the steam cracking furnace had burners disposed on the enclosure walls in five horizontal rows situated equally spaced out from one another. The thermal power of the assembly of burners was homogeneously distributed between the five rows.

A mixture of naphtha and steam identical with that used in Example 1 flowed in the cracking tube. Having regard to the relatively high load losses in the cracking tube, the flow rates of naphtha and steam were 3500 kg/h and 875 kg/h respectively.

The cracking temperature of the mixture of naphtha and steam was 490° C. at the inlet of the radiation zone of the furnace up to 775° C. at its outlet. The development of the cracking temperature of the mixture along the cracking tube is described by curve (b) in FIG. 4, showing on the abscissa axis the reaction volume (in liters) through which the mixture passes and on the ordinate axis the cracking temperature (in °C.) of the mixture. The curve (b) shows that the cracking temperature of the mixture increases in its initial portion quickly as a function of the reaction volume through which the mixture passes. The pressure of the mixture at the outlet of the furnace was 170 kPa.

The mean dwell time of the mixture of naphtha and steam flowing in the cracking tube between the inlet and the outlet of the radiation zone of the furnace was 830 milliseconds.

In these conditions 588 kg ethylene, 501 kg propylene, 95 kg isobutene, 147 kg butadiene and 155 kg ethane were produced per hour. The ethane thus produced in the furnace was then subjected to a secondary steam cracking stage enabling it to be converted into ethylene with a yield by weight of 85%, thus improving the global ethylene production of the steam cracking installation. It was found that the productions of olefins and diolefins were lower than those of Example 2 and that the productions of propylene, isobutene and butadiene in comparison with the production of ethylene were relatively less high than those observed in Examples 1 and 2. Thus, for 1 tonne of ethylene produced and collected at the outlet of the steam cracking installation, the productions of propylene, isobutene and butadiene were 796 kg, 132 kg and 204 kg respectively.

Moreover, the selectivity $S_3$ and $S_4$ selectivities were as follows:

$S_3=0.70$ $S_4=0.48$

These two values are less high than those obtained in Examples 1 and 2.

Moreover, the loss of maximum capacity of such a steam cracking furnace is about 35%, for an unaltered volume of the thermal radiation enclosure and for substantially identical mechanical and thermal stresses of the furnace, in comparison with the furnace disclosed in Example 1.

EXAMPLE 4 (FOR COMPARISON)

A steam cracking furnace comprised a thermal radiation enclosure identical in shape and size with that of Example 1. A nickel and chromium based refractory steel cracking tube was disposed in the enclosure and had a total weight substantially identical with that of Example 1 and an internal diameter of 140 mm, a thickness of 8 mm and, having regard to the capacity of the enclosure and the mechanical and thermal stresses of the furnace, a total length of 64 meters between the inlet and outlet of the enclosure. The ratio between the length and the mean internal diameter of the tube was 457. The cracking tube was disposed in the form of a coil comprising eight horizontal straight portions each of equal length which were interconnected via bends. The internal diameter of the straight portions was constant and equal to 140 mm. Thus, the internal diameters of the tube at the inlet and outlet of the enclosure were identical. Similarly, the reaction volume of the first half of the cracking tube length, corresponding to the first four straight portions, was identical with the reaction volume of the second half of the cracking tube, corresponding to the last four straight portions.

The thermal radiation enclosure of the steam cracking furnace had burners disposed on the enclosure walls in five horizontal rows situated equally spaced out from one another. The thermal power of the assembly of burners was homogeneously distributed between the five rows.

A mixture of naphtha and steam identical with that used in Example 1 flowed in the cracking tube. The flow rates of naphtha and steam were 3500 kg/h and 875 kg/h respectively.

The cracking temperature of the mixture of naphtha and steam rose from 500° C. at the inlet of the radiation zone of the furnace up to 775° C. at its outlet. The pressure of the mixture at the outlet of the furnace was 170 kPa.

The mean dwell time of the mixture of naphtha and steam flowing in the cracking tube between the inlet and the outlet of the radiation zone of the furnace was 900 milliseconds.

In these conditions 585 kg ethylene, 506 kg propylene, 101 kg isobutene, 156 kg butadiene and 150 kg ethane were produced per hour. The ethane thus produced in the furnace was then subjected to a secondary steam cracking stage enabling it to be converted into ethylene with a yield by weight of 85%, thus improving the global ethylene production of the steam cracking installation. It was found that the productions of propylene, isobutene and butadiene were relatively low. Thus for 1 tonne of ethylene produced and collected at the outlet of the steam cracking installation, the productions of propylene, isobutene and butadiene were 710 kg, 140 kg and 219 kg respectively.

Moreover, the selectivity $S_3$ and $S_4$ selectivities were as follows:

$S_3=0.715$ $S_4=0.500$

These two values are less high than those obtained in Example 1.

EXAMPLE 5

Operations were performed in a steam cracking furnace identical with that of Example 1, except that the thermal power of the assembly of burners was not distributed homogeneously between the 5 rows of burners, but was distributed as follows:

- 5% of the total thermal power on the first row of burners, disposed at the top of the enclosure adjacent the inlet of the cracking tube,
- 10% on the second row of burners, disposed immediately below the first row,
- 15% on the third row of burners, disposed immediately below the second row,
- 30% on the fourth row of burners, disposed immediately below the third row, and
- 40% on the fifth row of burners, disposed immediately below the fourth row, adjacent the outlet of the cracking tube. The ratio between the thermal power of the burners applied to the first half of the tube, situated towards the inlet of the enclosure, and that applied to the second half of the tube, situated towards the outlet of such enclosure, was therefore 22.5/77.5.

Figure 2:
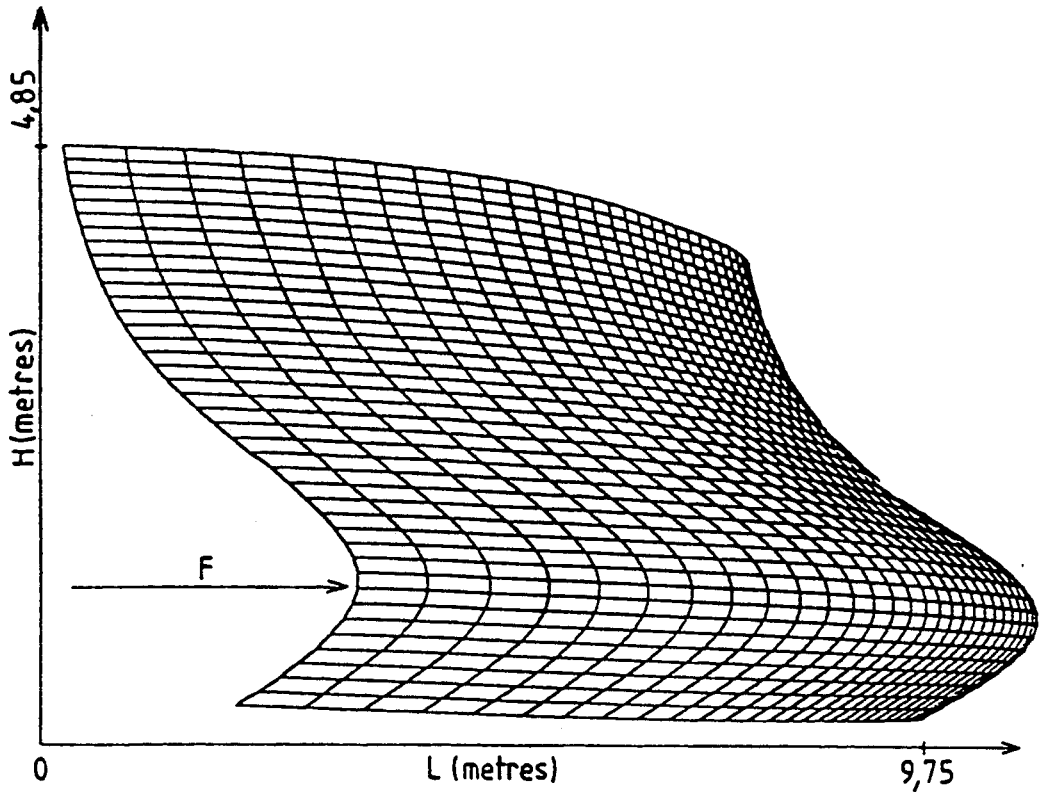
FIGS. 2 and 3 are tridimensional graphs representing the distribution of the thermal flow inside the thermal radiation enclosure of the horizontal steam cracking furnace, such distribution being obtained by a non-homogeneous and homogeneous heating power respectively.

The sheet of heat flux measured inside the thermal radiation enclosure of the furnace is in these conditions represented in FIG. 2 by the surface inscribed in the tridimensional graph connecting via the three coordinate axes the length L of the thermal enclosure, the height H of such enclosure and the heat flux F. FIG. 2 shows more particularly that the maximum of the thermal radiation flux was situated in the lower part of the thermal enclosure, corresponding to the second half of the length of the cracking tube, situated towards the outlet of the thermal radiation enclosure.

A mixture of liquid hydrocarbons and steam flowed in the cracking tube. The liquid hydrocarbons were formed by a naphtha of density 0.690 having an ASTM distillation range of 45°/180° C. and contents by weight of 38.2% linear paraffin waxes, 36.9% branched paraffin waxes, 17.1% cyclane compounds and 7.8% aromatic compounds. The composition of the mixture of naphtha and steam used was such that the ratio by weight between the quantity of naphtha and the quantity of steam was 4. The naphtha was therefore introduced into the cracking tube at a flow rate of 3500 kg/h and the steam at a flow rate of 875 kg/h.

Figure 5:
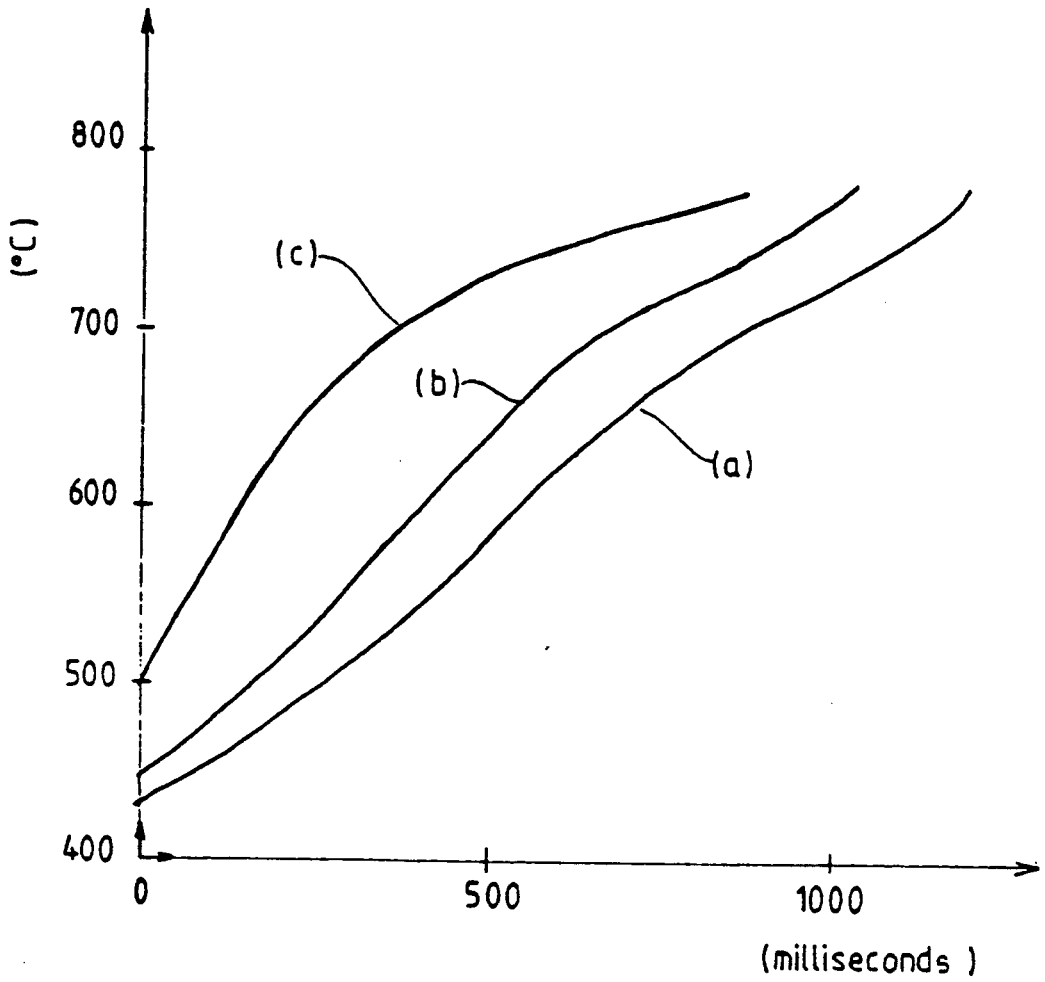
FIG. 5 is a graph showing the increase in cracking temperature of a mixture of hydrocarbons and steam flowing in a cracking tube from the inlet to the outlet of the radiation zone of a horizontal steam cracking furnace as a function of the mean dwell time of the mixture in the furnace.

The cracking temperature of the mixture of naphtha and steam rose from 435° C. at the inlet of the radiation zone of the furnace up to 775° C. at its outlet. The development of the cracking temperature of the mixture along the cracking tube is described by curve (a) in FIG. 5, showing on the abscissa axis the mean dwell time (in milliseconds) of the mixture flowing in the cracking tube from the inlet to the outlet of the radiation zone of the furnace, and on the ordinate axis the cracking temperature (in °C.) of the mixture. The curve (a) shows that the cracking temperature of the mixture increases in its initial portion relatively quickly as a function of the mean dwell time of the mixture in the cracking tube, and more particularly that the majority of the dwell time of the mixture is at a relatively low cracking temperature, more particularly a temperature lower than 700° C. The pressure of the mixture at the furnace outlet was 170 kPa. Having regard to the distribution of the heat flux in the thermal radiation enclosure, the thermal power applied to the second half of the length of the cracking tube, situated towards the outlet of the radiation zone, was 3.4 times greater than that applied to the first half of the tube length, situated towards the inlet of such zone.

The mean dwell time of the mixture of naphtha and steam flowing in the cracking tube between the inlet and the outlet of the furnace radiation zone was 1180 milliseconds. Moreover, the mean dwell time of the mixture flowing in the first half of the cracking tube length was 2.6 times greater than that in the second half of the tube length.

In these conditions 620 kg ethylene, 590 kg propylene, 110 kg isobutene, 180 kg butadiene and 150 kg ethane were produced per hour. The ethane thus produced in the furnace was then subjected to a secondary steam cracking stage enabling it to be converted into ethylene with a yield by weight of 85%, thus improving the global ethylene production of the steam cracking installation. It was also noted that the productions of higher olefins and butadiene were relatively high in relation to ethylene production. Thus, for 1 tonne of ethylene produced and collected at the outlet of the steam cracking installation, the productions of propylene, isobutene and butadiene were 790 kg, 147 kg and 240 kg respectively.

Moreover, the selectivity $S_3$ in produced hydrocarbons having 3 carbon atoms and the selectivity $S_4$ in produced hydrocarbons having 4 carbon atoms were as follows:

$S_3=0.79$ $S_4=0.57$

These two relatively high values indicate that the reaction of naphtha steam cracking thus performed encouraged the formation of olefins having 3 to 4 carbon atoms and also the formation of butadiene.

EXAMPLE 6

Operations were performed in a steam cracking furnace identical with that of Example 5. A mixture of naphtha and steam identical with that used in Example 5 flowed in the cracking tube of the furnace. The flow rates of naphtha and steam flowing in the tube were 4800 kg/h and 1200 kg/h respectively; this increase of the flow rates in comparison with that of Example 5 could easily be produced, since the cracking tube used had a relatively low load loss.

In these conditions the cracking temperature of the mixture of naphtha and steam rose from 445° C. at the inlet of the radiation zone of the furnace up to 775° C. at its outlet. The development of the cracking temperature of the mixture along the cracking tube is described by curve (b) in FIG. 5, showing on the abscissa axis the mean dwell time (in milliseconds) of the mixture flowing in the cracking tube from the inlet to the outlet of the radiation zone of the furnace, and on the ordinate axis the cracking temperature (in °C.) of the mixture. The curve (b) shows that the cracking temperature of the mixture increases in its initial portion relatively quickly as a function of the mean dwell time of the mixture in the cracking tube, and that more particularly the majority of the dwell time of the mixture is at a relatively low cracking temperature, more particularly a temperature lower than 700° C. The pressure of the mixture was 170 kPa at the furnace outlet.

In these conditions the mean dwell time of the mixture of naphtha and steam flowing in the cracking tube between the inlet and the outlet of the radiation zone of the furnace was 1020 milliseconds. Moreover, the mean dwell time of the mixture flowing in the first half of the cracking tube length was 2.6 times greater than that in the second half of the tube length. The resulting hourly production was 750 kg ethylene, 770 kg propylene, 110 isobutene, 180 butadiene and 200 ethane. The ethane thus produced in the furnace was then subjected to a secondary steam cracking stage enabling it to be converted into ethylene with yield by weight of 85%, thus enhancing the global ethylene production of the steam cracking installation. It was found that the productions of olefins and diolefins were higher than those of Example 5, because of the increased flow rates of raw materials which the steam cracking furnace according to the invention enables to be achieved. It was also observed that the productions of higher olefins and butadiene were relatively high in relation to ethylene production. Thus, the productions of propylene, isobutene and butadiene were 837 kg, 158 kg and 260 kg respectively for one tonne of ethylene produced and collected at the outlet of the steam cracking installation.

The $S_3$ and $S_4$ selectivities were also as follows:

$$S_3=0.84$$

$$S_4=0.61.$$

These two relatively high values indicated that for this kind of furnace using the process according to the invention, the naphtha steam cracking reaction encouraged the formation of olefins having 3 to 4 carbon atoms, and also the formation of butadiene, at the expense of the formation of ethylene.

EXAMPLE 7 (FOR COMPARISON)

Operations were performed in a steam cracking furnace comprising a thermal enclosure, a cracking tube and burners, identical with those of Example 3 (for comparison). Also as in Example 3 (for comparison) the thermal power of the assembly of burners was homogeneously distributed between the five rows.

Figure 3:
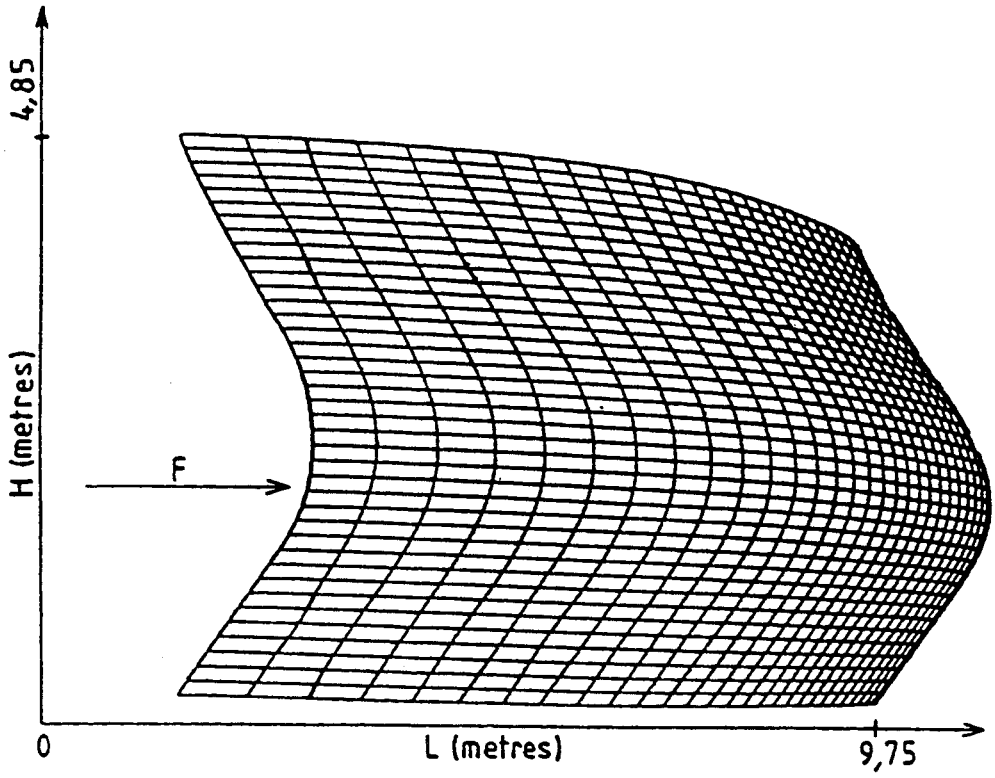

The sheet of heat flux measured inside the thermal radiation enclosure of the furnace is in these conditions represented in FIG. 3 by the surface inscribed in the tridimensional graph connecting via the three coordinate axes, the length L of the thermal enclosure, the height H of such enclosure and the heat flux F. FIG. 3 shows more particularly that the maximum of the thermal radiation flux was situated in the upper part of the thermal enclosure, corresponding to the first half of the length of the cracking tube, situated towards the inlet of the thermal radiation enclosure.

A mixture of naphtha and steam identical with that used in Example 5 flowed in the cracking tube. Having regard to the relatively high load losses in the cracking tube, the flow rates of naphtha and steam were 3500 kg/h and 875 kg/h respectively.

The cracking temperature of the mixture of naphtha and steam rose from 495° C. at the inlet of the radiation zone of the furnace up to 775° C. at its outlet. The development of the cracking temperature of the mixture along the cracking tube is described by curve (c) in FIG. 5, showing on the abscissa axis the mean dwell time (in milliseconds) of the mixture flowing in the cracking tube from the inlet to the outlet of the radiation zone of the furnace, and on the ordinate axis the cracking temperature (in °C.) of the mixture. The curve (c) clearly shows that the cracking temperature of the mixture increases quickly in its initial portion as a function of the dwell time of the mixture in the cracking tube, and more particularly that a considerable proportion of the dwell time of the mixture is at a relatively high cracking temperature, more particularly at a temperature higher than 700° C. The pressure of the mixture at the outlet of the furnace was 170 kPa. Having regard to the distribution of the heat flux in the enclosure, the thermal power applied to the second half of the cracking tube length is identical with that applied to the first half of the tube length.

The mean dwell time of the mixture of naphtha and steam flowing in the cracking tube between the inlet and the outlet of the furnace radiation zone was 840 milliseconds.

In these conditions 635 kg ethylene, 545 kg propylene, 90 kg isobutene, 140 kg butadiene and 170 kg ethane were produced per hour. The ethane thus produced in the furnace was then subjected to a secondary steam cracking stage enabling it to be converted into ethylene with a yield by weight of 85%, thus improving the global ethylene production of the steam cracking installation. It was also found that the productions of olefins and diolefins were lower than those of Example 6 and that the productions of propylene, isobutene and butadiene in comparison with ethylene production were relatively less high than in Examples 5 and 6. Thus, for 1 tonne of ethylene produced and collected at the outlet of the steam cracking installation, the productions of propylene, isobutene and butadiene were 700 kg, 115 kg and 180 kg respectively.

Moreover, the selectivity $S_3$ and $S_4$ were as follows:

$$S_3=0.700$$

$$S_4=0.465$$

These two values are high than those obtained in Examples 5 and 6.

Moreover, the maximum loss of capacity in such a steam cracking furnace was about 35%, for an unaltered volume of the thermal radiation enclosure and for substantially identical mechanical and thermal stresses of the furnace, in comparison with the furnace disclosed in Example 5.

EXAMPLE 8

A steam cracking furnace such as that shown diagrammatically in FIG. 1 comprised a thermal radiation enclosure (1) identical with that described in Example 1. A nickel and chromium based refractory steel cracking tube was disposed in the enclosure and had different dimensions from that disclosed in Example 1; it had a mean internal diameter of 108 mm, and, having regard to the capacity of the enclosure (1), a total length of 80 m between the inlet (10) and the outlet (11). The cracking tube was disposed in the form of a coil comprising 8 horizontal straight portions each of equal length which were interconnected via bends. The internal diameter of the sections (2) and (3) situated towards the inlet of the thermal enclosure was 135 mm; the following sections (4) and (5) had an internal diameter of 117 mm; then the sections (6) and (7) had an internal diameter of 99 mm; the internal diameter of the sections (8) and (9) situated towards the outlet of the thermal enclosure was 81 mm.

Moreover, the internal diameters of the cracking tube at the inlet (10) and outlet (11) of the enclosure (1) being 135 mm and 81 mm respectively, the ratio between the internal diameters of the tube at the inlet and outlet was therefore 1.7. The reaction volume of the first half of the cracking tube length, corresponding to the straight portions (2), (3), (4), (5), was moreover 1.95 times greater than the reaction volume of the second half of the cracking tube length, corresponding to the straight portions (6), (7), (8) and (9).

The thermal radiation enclosure of the steam cracking furnace had burners disposed on the walls of the enclosure in five horizontal rows equally spaced out from one another. The total thermal power was distributed between these five rows of burners as follows:

- 5% of the total thermal power on the first row of burners, disposed at the top of the enclosure adjacent the inlet of the cracking tube,
- 10% on the second row of burners, disposed immediately below the first row,
- 20% on the third row of burners, disposed immediately below the second row,
- 25% on the fourth row of burners, disposed immediately below the third row, and
- 40% on the fifth row of burners, disposed immediately below the fourth row, adjacent the outlet of the cracking tube. The ratio between the thermal power of the burners applied to the first half of the tube, situated towards the inlet of the enclosure, and that applied to the second half of the tube, situated towards the outlet of such enclosure, was therefore 25/75.

A mixture of ethane and steam flowed in the cracking tube. The composition of the mixture of ethane and steam used was such that the ratio by weight between the quantity of ethane and the quantity of steam was 2.25. Ethane was therefore introduced into the cracking tube at a flow rate of 1800 kg/h and 800 kg/h.

The cracking temperature of the mixture of ethane and steam rose from 585° C. at the inlet of the radiation zone of the furnace up to 846° C. at its outlet. The pressure of the mixture was 170 kPa at the furnace outlet. Having regard to the distribution of the heat flux in the enclosure, the thermal power applied to the second half of the cracking tube length, situated towards the outlet of the radiation zone. was 3 times greater than that applied to the first half of the tube length, situated towards the inlet of such zone.

The mean dwell time of the mixture of ethane and steam flowing in the cracking tube between the inlet and outlet of the radiation zone of the furnace was 640 milliseconds.

In these conditions 850 kg of ethylene and 55 kg of methane were produced per tonne of ethane converted. It was noted that the ethylene selectivity was therefore 85%.

EXAMPLE 9 (for comparison)

Operations were performed in a steam cracking furnace comprising a thermal enclosure, a cracking tube and burners, identical with those of Example 3 (for comparison). Also as in Example 3 (for comparison) the thermal power of the assembly of burners was homogeneously distributed between the five rows.

A mixture of ethane and steam identical with that used in Example 8 flowed in the cracking tube. The ethane was introduced at a flow rate of 1800 kg/h and the steam at a flow rate of 800 kg/h.

The cracking temperature of the mixture of ethane and steam rose from 636° C. at the inlet of the radiation zone of the furnace up to 846° C. at its outlet. The pressure of the mixture at the outlet of the furnace was 170 kPa. Having regard to the distribution of the heat flux in the enclosure, the thermal power applied to the second half of the cracking tube length was identical with that applied to the first half of the tube length.

The mean dwell time of the mixture of ethane and steam flowing in the cracking tube between the inlet and the outlet of the radiation zone of the furnace was 585 milliseconds.

In these conditions 805 kg ethylene and 71 kg of methane were produced per tonne of ethane converted.

It was found that the ethylene selectivity was 80.5%, a value lower than that of Example 8, and that the quantity of methane produced increased in comparison with that of Example 8.

EXAMPLE 10

Operations were performed exactly as in Example 8, except that instead of using ethane, use was made of a mixture of gaseous hydrocarbons containing 76% by weight ethane, 19% by weight propane and 5% by weight propylene. The pressure at the outlet of the furnace was 175 kPa, instead of 170 kPa. The cracking temperature of the mixture at the entry of the radiation zone was 575° C., instead of 585° C., and at the outlet of the zone 848° C., instead of 846° C. The mean dwell time of the mixture of gaseous hydrocarbons and steam flowing in the cracking tube between the inlet and the outlet of the radiation zone was 665 milliseconds, instead of 640 milliseconds.

In these conditions 785 kg of ethylene and 120 kg of methane were produced per tonne of the mixture of gaseous hydrocarbons converted. It was found that the ethylene selectivity was 78.5%.

EXAMPLE 11 (for comparison)

Operations were performed exactly as in Example 9 (for comparison), except that instead of using ethane, use was made of a mixture of gaseous hydrocarbons identical with that used in Example 10. The pressure of the mixture at the outlet of the furnace was 175 kPa, instead of 170 kPa. The cracking temperature of the mixture was 610° C. at the inlet of the radiation zone, instead of 636° C., and at the outlet of the zone 848° C., instead of 846° C. The dwell time of the mixture of gaseous hydrocarbons and steam flowing in the cracking tube between the inlet and the outlet of the radiation zone was 610 milliseconds, instead of 585 milliseconds.

In these conditions 750 kg of ethylene and 195 kg of methane were produced per tonne of mixture of gaseous hydrocarbons converted. It was found that the ethylene selectivity was 75%, a value lower than that of Example 10, and that the quantity of methane produced had substantially increased.

We claim:

1. An apparatus for cracking hydrocarbons in the presence of steam, comprising a thermal radiation enclosure having a plurality of heating means, at least one cracking tube within said enclosure through which the mixture of steam and hydrocarbons for cracking flows, said cracking tube having a length, an inlet, an outlet spaced from said inlet in a predetermined direction transverse to the length of the cracking tube, a lengthwise first half situated towards the inlet, a lengthwise second half situated towards the outlet, and a varying internal diameter with a mean internal diameter; wherein:

(a) the ratio between the length and the mean internal diameter of the cracking tube within the thermal radiation enclosure is between 200 and 600;

(b) the internal diameter of the cracking tube varies such that said internal diameter diminishes continuously or in stages in the direction of the length of the cracking tube from the inlet to the outlet, so that the ratio between the internal diameters of the tube at the inlet and outlet is between 1.2 and 3 and the reaction volume per unit of the cracking tube length diminishes continuously or in stages in the direction of the length of the cracking tube from the inlet to the outlet;

(c) said first half of said cracking tube comprising a plurality of sections extending transversely to said predetermined direction from said inlet to said outlet and said second half of said cracking tube comprising a plurality of sections extending transversely to said predetermined direction from said inlet to said outlet; and (d) each of the plurality of heating means providing a heating capacity sufficient to provide different amounts of thermal power and is disposed within the enclosure with one of the heating means disposed adjacent said plurality of sections of said first half nearer the inlet and with another of said heating means disposed adjacent said plurality of sections of said second half and providing a ratio between the thermal power applied to the lengthwise first half of the cracking tube and that applied to the lengthwise second half of the cracking tube between 40/60 and 15/85.

2. An apparatus according to claim 1 wherein the plurality of heating means are formed by a plurality of rows of burners disposed within the enclosure and spaced from each other in said predetermined direction.

3. An apparatus according to claim 1 wherein the plurality of heating means comprises a plurality of burners spaced from each other in the direction of the length of the cracking tube from said inlet to said outlet, means for supplying fuel to said burners and means to control the supply of fuel to said burners for controlling the thermal power applied along the length of the cracking tube.

4. An apparatus according to claim 1 wherein, in the direction of the length of the cracking tube from the inlet to the outlet, successive said sections decrease in internal diameter.

5. Apparatus according to claim 1 wherein the volume of the lengthwise first half of the cracking tube is 1.3 to 4 times greater than the volume of the lengthwise second half of the cracking tube.

6. An apparatus cracking hydrocarbons in the presence of steam and providing a product comprising olefins and diolefins, comprising a thermal radiation enclosure having heating means, at least one cracking tube within said enclosure through which the mixture of steam and hydrocarbons for cracking flows, said cracking tube having a length, an inlet, an outlet, a lengthwise first half situated towards the inlet, a lengthwise second half situated towards the outlet, and a varying internal diameter with a mean internal diameter, and means supplying a mixture of said hydrocarbons and steam to said inlet of said cracking tube, wherein:

(a) the ratio between the length and the mean internal diameter of the cracking tube within the thermal radiation enclosure is between 200 and 600;

(b) the internal diameter of the cracking tube varies such that said internal diameter diminishes continuously or in stages in the direction from the inlet to the outlet, so that the ratio between the internal diameters of the tube at the inlet and outlet is between 1.2 and 3 and the reaction volume per unit of the cracking tube length diminishes continuously or in stages in the direction of the length of the cracking tube from the inlet to the outlet;

(c) the heating means provides thermal power along the length of the cracking tube which increases from the inlet to the outlet in a ratio between the thermal power applied to the lengthwise first half of the cracking tube and that applied to the lengthwise second half of the cracking tube between 40/60 and 15/85.

7. Apparatus as set forth in claim 6 wherein said heating means provides thermal power to said first half of said tube which heats the mixture in said first half of said tube to a temperature in the range between 400° and 700° C. and provides thermal power to said second half of said tube which heats the products at said outlet of said tube to between 720° C. and 880° C.

8. Apparatus as set forth in claim 6 wherein said tube is free of catalyst.

9. Apparatus as set forth in claim 6 wherein the volume of the lengthwise first half of the cracking tube is 1.3 to 4 times greater than the volume of the lengthwise second half of the cracking tube.

10. An apparatus for cracking hydrocarbons in the presence of steam, comprising a thermal radiation enclosure having heating means, at least one cracking tube within said enclosure through which the mixture of steam and hydrocarbons for cracking flows, said cracking tube having a length, an inlet, an outlet, a lengthwise first half situated towards the inlet, a lengthwise second half situated towards the outlet, and a varying internal diameter with a mean internal diameter, wherein:

(a) the ratio between the length and the mean internal diameter of the cracking tube within the thermal radiation enclosure is between 200 and 600, and (b) the internal diameter of the cracking tube varies such that said internal diameter diminishes continuously or discontinuously in the direction from the inlet to the outlet, so that the ratio between the internal diameters of the tube at the inlet and outlet is between 1.2 and 3, and, (c) the heating means are formed by a plurality of burners disposed within the enclosure in spaced relation in the direction from the inlet to the outlet, the burners having different sizes and calorific power and the burners of larger size and calorific power being disposed nearer the outlet than the burners of lower size and calorific power for providing a ratio between the thermal power applied to the lengthwise first half of the cracking tube and that applied to the lengthwise second half of the cracking tube between 40/60 and 15/85.

11. Apparatus as set forth in claim 10 wherein said mean internal diameter is in the range from 70 to 250 mm.

12. Apparatus as set forth in claim 11 wherein said cracking tube is in the form of a coil consisting of a succession of straight portions interconnected by bends.

13. Apparatus as set forth in claim 10 wherein said mean internal diameter is in the range from 100 to 250 mm.

14. Apparatus as set forth in claim 10 wherein said mean internal diameter is in the range from 70 to 160 mm.

* * * * *